US011324286B2

(12) United States Patent
Crowley

(10) Patent No.: US 11,324,286 B2
(45) Date of Patent: May 10, 2022

(54) INVISIBLE TIE CLIP

(71) Applicant: Curtis Vincent Crowley, Edmonton (CA)

(72) Inventor: Curtis Vincent Crowley, Edmonton (CA)

( * ) Notice: Subject to any disclaimer, the term of this patent is extended or adjusted under 35 U.S.C. 154(b) by 0 days.

(21) Appl. No.: 17/004,491

(22) Filed: Aug. 27, 2020

(65) Prior Publication Data

US 2022/0061466 A1 Mar. 3, 2022

(51) Int. Cl.
*A44B 6/00* (2006.01)
*A41D 25/00* (2006.01)

(52) U.S. Cl.
CPC ..... *A44B 6/00* (2013.01); *A41D 25/003* (2013.01)

(58) Field of Classification Search
CPC ..... A44B 6/00; A41D 25/003
See application file for complete search history.

(56) References Cited

U.S. PATENT DOCUMENTS 2,024,943 A * 12/1935 Mix ..... A44B 6/00 24/66.2
3,173,181 A * 3/1965 Marien ..... A44B 6/00 24/66.2
3,204,306 A * 9/1965 Anderson ..... A44B 6/00 24/52
5,097,569 A 3/1992 Erickson
5,361,460 A 11/1994 Pan
5,526,550 A * 6/1996 Huang ..... A44B 6/00 24/66.2
5,926,923 A 7/1999 Smith
5,979,021 A * 11/1999 Swift ..... A41D 25/003 24/546
6,216,275 B1 4/2001 Lee
6,954,943 B1 10/2005 Boyko
7,370,371 B2 5/2008 Butterfas et al.
8,966,716 B1 3/2015 Mortimer
9,629,403 B2 4/2017 Arena
2004/0006849 A1* 1/2004 Bishop ..... A45F 5/02 24/3.4
2008/0034465 A1 2/2008 Pfanner

FOREIGN PATENT DOCUMENTS

DE 29702015 U1 * 6/1997 ..... A41D 25/003
DE 29702015 U1 6/1997

* cited by examiner

*Primary Examiner* — Robert Sandy
(74) *Attorney, Agent, or Firm* — Stratford Group Ltd.

(57) ABSTRACT

The present invention relates to an invisible tie clip mounted to the back of the tie, that holds the entire length of the tie in place. The device can accommodate any width of tie and is placed at bottom portion of the tie and attached to the front button hole seam of a shirt or to a button on the shirt. It is fast and easy to put on or readjust. It is strong and reusable and can also be worn with conventional clips or chains.

19 Claims, 4 Drawing Sheets

INVISIBLE TIE CLIP

FIELD OF THE INVENTION

The present disclosure relates to tie clips, particularly to invisible tie clips, more particularly to tie clips that hold the entire length of the tie in place.

BACKGROUND

U.S. Pat. No. 7,370,371 discloses a necktie fastener system capable of restraining the bottom portion of the necktie close to the shirt of a wearer. There is an H shape which is attached to the back of the apron of the necktie by hot ironing. The H shape is relatively flexible allowing easy formation of the various necktie knots. The wearer inserts the elongated placket under the horizontal bar and attaches the placket to two adjacent shirt buttons. The resulting combination slidably secures the end of the necktie nearest the bottom of the tie to stay near the shirt of the wearer.

U.S. Pat. No. 6,216,275 discloses a necktie with fixing device to maintain a necktie in place. The fixing device comprises an anchoring member that is secured to the rear surface of the wide end of the necktie. The combined securing action of the magnet and hook allow the fixing device to maintain the wide end of a necktie in place.

U.S. Pat. No. 5,361,460 discloses a tie clip that can be put to a front opening of a shirt through the clip opening. The tie clip has inner and outer plates form into a clip opening for fastening to a part of a front opening of a shirt. The tie clip comprises a body portion which is formed with a resilient thin plate bent into several folds, and a chain mounted on both sides of the tie clip.

U.S. Pat. No. 5,097,569 discloses a tie tack to secure a four-in-hand necktie to a shirt with minimal lateral movement of the necktie and without puncturing the front pendant of the necktie. A four-link chain extends from the tie back tack and is attached to a removable clasp. The removable clasp attaches to the front edge of the shirt and keeps the necktie not only in place but centered at all times. The tie tack attaches the pendants of a necktie to the shirt without being seen.

U.S. Pat. No. 9,629,403 discloses a method of securing and aligning a necktie on a shirt. The method includes an object with flexible material loops protruding from two sides of the object. The object is put through a necktie loop located on the rear portion of a necktie and remains in this position while the flexible material loops are then attached to the two closest buttons on a shirt. This method secures a necktie to a shirt, whereby ensuring that a necktie remains vertically aligned over the buttons on a shirt, while at the same time the invention remains hidden from view while in use.

US20080034465 discloses clothing accessories such as neckties that for convenience and/or fashion purposes are desirably removably engaged to an article of clothing such as shirts. Further, the engaging apparatus is substantially hidden from an external view without tie pins, tie bars, stickpins, brooches, and the like. When the clothing accessory is a dress tie with a front apron, a rear apron, and a loop positioned approximately transverse to the dress tie. The method comprises the step of inserting an end portion of the device therethrough the dress tie loop, resulting in a slidable engagement or freedom of vertical movement between the dress tie front apron loop and the closed end loop.

DE29702015 discloses a device for fixing a tie to the shirt, wherein the device is to be mounted on the back of the wide tie end and consists of a retaining band which can be attached with its one end portion on the back of the tie and with the other end portion on the button or buttonhole bar on the shirt.

U.S. Pat. No. 6,954,943 discloses restraining devices for neck apparel, such as a necktie, for attaching an item of neck apparel in place on the shirt of a person wearing an item of neck apparel are provided, the shirt being of a type having a plurality of buttons spaced along its front. The restraining device comprises an elongate, flexible cord having a first button loop formed at a first end of the cord and a second button loop formed at a second end of the cord opposite the first end.

U.S. Pat. No. 8,966,716 discloses an apparatus for restraining a portion of a distal portion of a neck-worn clothing accessory, such as a neck tie, scarf, or other such clothing accessory, by connecting a rear, or underneath, portion of the clothing accessory to an underlying garment. An engaging barb element may be utilized to engage either a tie label, or a tie insert, both of which may already exist on a neck tie, for the purpose of securing the neck tie to the underneath portion engaging element.

U.S. Pat. No. 5,926,923 discloses a tie retaining device that includes a fastener part having a front side and a back side, the front side supporting a pair of opposed, laterally projecting barbs, and the back side including an eyelet. The retaining device also includes a retainer clip having an opening for receiving a button of a shirt to secure the retainer clip to the shirt.

None of the above cited documents, alone or in combination satisfy the need for invisible tie clip mounted to the back of the tie, that holds the entire length of the tie in place and that can accommodate any width of tie. There therefore remains a need for such a device which can additionally easily unclip from the shirt when the wearer is seated.

BRIEF SUMMARY

It is an object of the invention to provide an invisible tie clip.

In accordance with an aspect of the invention there is provided a device for anchoring a tie to a shirt, comprising: a flexible semi-circular portion; first and second arms positioned at opposite ends of the semi-circular portion; a central connection portion defined between said first and second arms; and a connection member having first and second ends, said first end being adapted to connect to said shirt and said second end being adapted to connect to the central portion of the semi-circular portion.

In accordance with another aspect of the invention there is provided a method of securing a tie to a shirt, said tie comprising an inner opening and opposing inner edges, said method comprising the steps: applying a compression force onto a flexible semi-circular portion of a device having first and second arms positioned at opposite ends of the semi-circular portion and defining a central connection portion; inserting said compressed flexible semi-circular portion into said inner opening of said tie; releasing said compression force from said semi-circular portion such that said first and second arms engage with said opposing inner edges of said tie in a friction fit connection; and attaching a connection member, that is connected to said central connection portion of the device, to said shirt.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The present invention describes an invisible tie clip mounted to the back of the tie, that holds the entire length of the tie in place. The device can accommodate any width of tie. In use it is placed at bottom portion of the tie and attached to the front seam of a shirt or a button on the shirt.

It is fast and easy to put on or readjust. It is invisible, strong and reusable. It can also be worn with conventional clips or chains if the wearer wishes to also wear and display one. The device slips into the opening in the back of ties and clips onto shirt. It holds the entire length of tie in place, centered, flat and hanging naturally.

Figure 1:
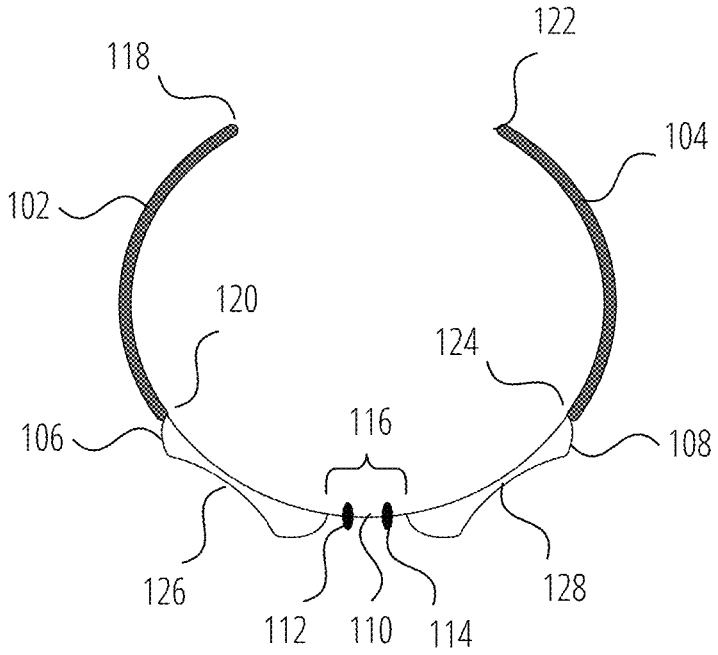
FIG. 1 illustrates an aspect of the subject matter in accordance with one embodiment.

FIG. 1 illustrates a side view of an embodiment of the invention. The figure shows the device in an open or expanded position. The device essentially comprises a semi-circle or arc fabricated from a flexible material. The device features a first arm 102 and a second arm 104 in spaced apart relationship. The first end 118 of the first arm 102 and the first end 122 of the second arm 104 define the semi-circular or arced portion of the device.

The second end 120 of the first arm 102 is situated in close proximity to a side of a first compression member 106. The second end 124 of the second arm 104 is situated in close proximity to a side of a second compression member 108. An opposing side of the first compression member 106 and an opposing side of the second compression member 108 defining a central connection portion 116. The central connection portion 116 is configured to comprise a first stop 112 and a second stop 114 defining a central connection point 110 therebetween.

The semi-circular or arced portion of the device is fabricated from a flexible material selected from, but not limited to, plastics or foams. The first arm 102 and second arm 104 portions of the semi-circular or arced portion of the device are typically covered in a sheath of rubber or foam, or dipped in a coating that renders the surface to have a high coefficient of friction. The covering or coating also serves to shield the first end 118 of the first arm 102 and the first end 122 of the second arm 104 to prevent them from becoming embedded into the fabric of the tie during placement within the body of the tie.

The first compression member 106 and second compression member 108 are typically fabricated from a soft and pliable material such as, but not limited to, plastics or foams. The first compression member 106 and second compression member 108 may be molded to form an indented section, digit indent 126 and digit indent 128, sized and proportioned to accommodate a finger and thumb respectively. Application of pressure by the finger and thumb on the first compression member 106 and second compression member 108 served to adjust the semi-circular or arced portion of the device from a first open configuration, as shown in FIG. 1, to a second installation configuration. In the second installation configuration, the semi-circular or arced portion of the device has a smaller diameter than in the first open configuration.

Figure 2:
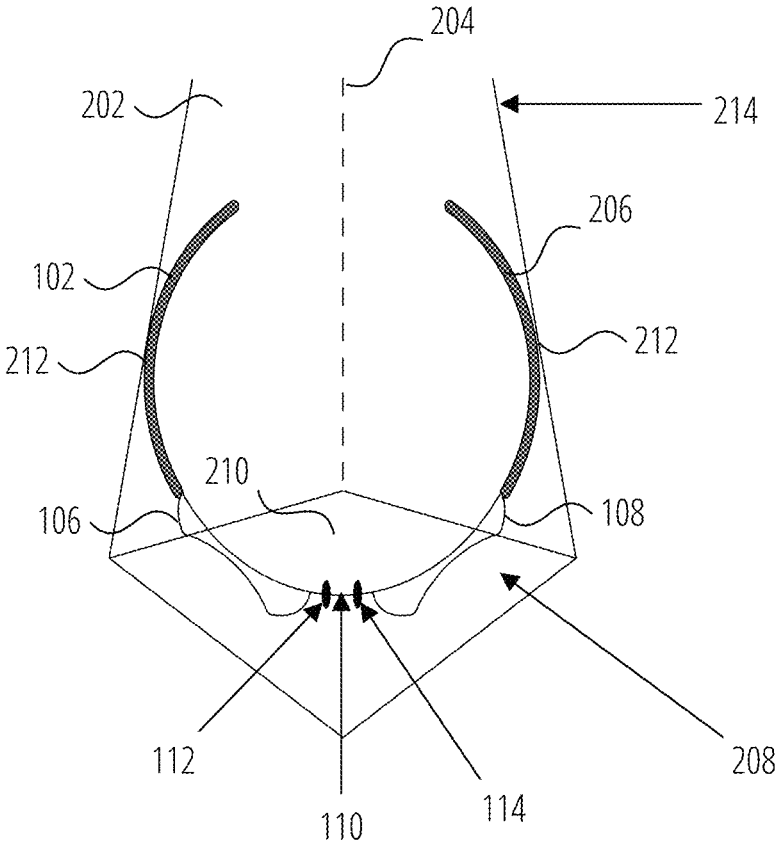
FIG. 2 illustrates an aspect of the subject matter in accordance with one embodiment.

FIG. 2 illustrates a side view of the device of an embodiment of the invention installed inside a tie 214. In order to install the device within the inner portion of the tie 210, pressure is applied to digit indent 126 and digit indent 128 on the first compression member 106 and second compression member 108 respectively. When the device is in its installation configuration, it can be inserted into the inner portion of the tie 210 that is formed on the backside of the tie 202 between the central seam of tie 204 and the back side of front of tie 208. When the device is at an appropriate position within inner portion of the tie 210, pressure is released from the digit indent 126 and digit indent 128 and the device expands until the first arm 102 and second arm 104 engage with the outer edges 212 of the tie 214. In its installed configuration, the diameter of the semi-circular or arced portion of the device is smaller than when in the open configuration, but larger than when in its installation configuration. The first arm 102 and second arm 104 of the device cooperate with the outer edges 212 of the tie 214 in a friction fit connection.

Figure 3:
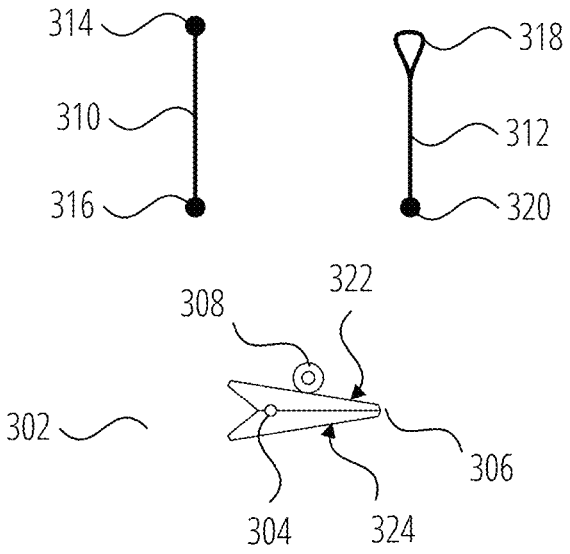
FIG. 3 illustrates an aspect of the subject matter in accordance with one embodiment.

FIG. 3 illustrates side views of two different embodiments of the means of connecting the device to the wearer's shirt. In one embodiment, the connection member 310 has a first connection end 314 and a second connection end 316. The first connection end 314 is configured to attach to a shirt via a clip 302. The second connection end 316 is configured to attach to the central connection point 110 between the first stop 112 and second stop 114.

The clip 302 may be of any configuration known to those of skill in the field, and may generally comprise a hinge 304 and jaws 306. In the embodiment illustrated in FIG. 3, the upper jaw 324 is configured to attach to the inner surface of a seam of the shirt and the lower jaw 322 is configured to attach to the outer surface of a seam of the shirt. An attachment means 308 is situated on the clip in a suitable position for attachment to the first connection end 314 of the connection member 310

In another embodiment, the connection member 312 has a first connection end 318 and a second connection end 320. The first connection end 318 is configured to attach to a button on a shirt. The second connection end 320 is similarly configured to attach to the central connection point 110 between the first stop 112 and second stop 114.

Figure 4:
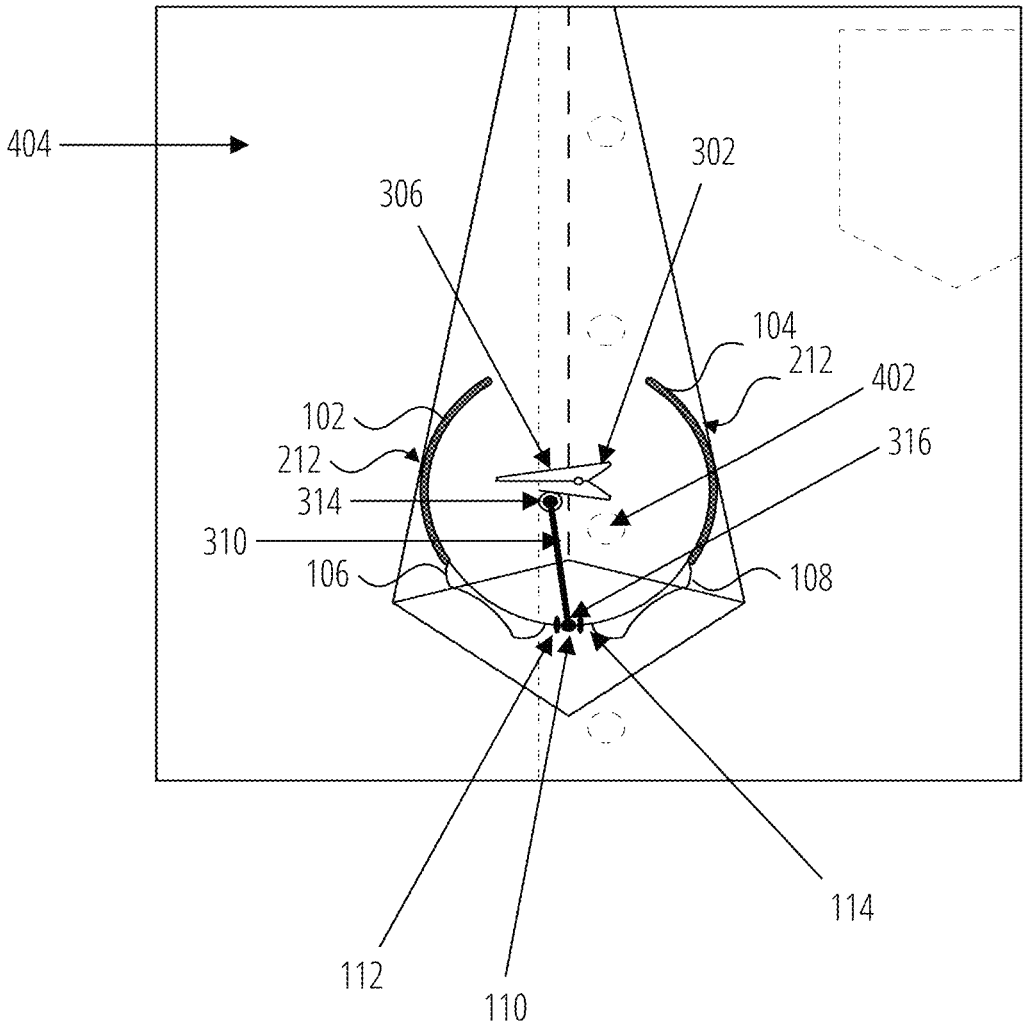
FIG. 4 illustrates an aspect of the subject matter in accordance with one embodiment.

FIG. 4 illustrates a front view the device installed within a tie 214 and attached to a shirt 404 via a clip 302. The device can be seen in its installed configuration, with the first arm 102 and second arm 104 in friction fit connection with the outer edges 212 of the tie 214. The connection member 310 is attached at the second connection end 316 to the central connection point 110 of the device between the first stop 112 and the second stop 114. The first stop 112 and second stop 114 serve to prevent the second connection end 316 from sliding out of position. The connection member 310 is attached at the first connection end 314 to the attachment means 308 on the clip 302. The clip 302 is then attached to the button hole seam of the shirt 404 via the jaws 306.

In an alternative embodiment, the connection member 312 is attached at the first connection end 318 (as shown in FIG. 3) to a shirt button 402.

Numerous different materials can be used to fabricate different parts of the device. It is contemplated that the semi-circular or arced portion of the device can be made from any material that is both lightweight and flexible. This may include, but is not limited to: plastic, Nylon, high or low-density polyethylene, polypropylene, polyvinyl chloride, or thermoplastic polyurethanes.

The first stop 112 and second stop 114 may be molded directly into the semi-circular or arced portion during manufacture, or it may be fabricated from a different material such as metal, rubber or elastic, or they may take the form of a hollow bead that is secured into position using a glue or resin.

The first arm 102 and second arm 104 may be dipped in a rubber or elastomeric material, including but not limited to EPDM rubber, neoprene rubber or PVC nitrile. In the alternative, the first arm 102 and second arm 104 may be covered in a foam selected from the group consisting of polyester, polyethylene, or polyether polyurethane foams.

The first compression member 106 and second compression member 108 is also made from a lightweight and likely compressible material which may be a foam selected from the group consisting of polyester, polyethylene, or polyether polyurethane foams.

The connection member 310 or connection member 312 can be made from any strong, and possibly extensible, material such as plastic, Nylon, or an elastomeric thread or fabric such as elastic. The length of the connection members 310 and 312 is variable, but typically in the region of 1". The clip can take many different forms, as can the attachment means 308 of the clip 302 to the second connection end 316.

When worn, the device anchors the entire length of the tie via a flexible connection, giving a more natural appearance than a conventional tie clips, chains or pins. The device stops the tie from swaying side to side when walking and is easily disconnected from the shirt when necessary, for example when the wearer sits down. It is suitable for use with ties of any width due to the compressibility of the semi-circular or arced portion.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A device for anchoring a tie to a shirt, comprising:
a flexible semi-circular portion;
first and second arms positioned at opposite ends of the semi-circular portion;
a central connection portion defined between said first and second arms, said central connection portion further comprises first and second stops; and
a connection member having first and second ends, said first end being adapted to connect to said shirt and said second end being adapted to connect to the central portion of the semi-circular portion.

2. The device of claim 1, wherein the semi-circular portion is made from a material selected from the group consisting of: plastic, Nylon, high or low-density polyethylene, polypropylene, polyvinyl chloride, or thermoplastic polyurethanes.

3. The device of claim 1, wherein said first and second arms are covered in or coated with a material having a high co-efficient of friction.

4. The device of claim 3, wherein the material is selected from the group consisting of: EPDM rubber; neoprene rubber; PVC nitrile; polyester, polyethylene, and polyether polyurethane foams.

5. The device of claim 1, wherein the first and second stops are molded directly into a semi-circular or arced portion during manufacture.

6. The device of claim 1, wherein the first and second stops are fabricated from the group consisting of: metal; rubber; elastic; and a hollow bead secured into position using a glue or resin.

7. The device of claim 1, wherein the second end of the connection member is a loop which is attached to the central connection portion between the first and second stops.

8. The device of claim 1, further comprising first and second compression grips attached to or formed on the semi-circular portion.

9. The device of claim 8, wherein the first and second compression grips are attached to or formed on the first and second arms.

10. The device of claim 8, wherein the first and second compression grips are attached to or formed between the first and second arms and the central connection portion.

11. The device of claim 8, wherein the first and second compression grips are fabricated from a material selected from the group consisting of: polyester; polyethylene; polyether; and polyurethane foams.

12. The device of claim 1, wherein the connection member is fabricated from a material selected from the group consisting of: plastic; Nylon; and an elastomeric thread or fabric.

13. The device of claim 1, wherein the first end of said connection member comprises a clip.

14. The device of claim 1, wherein the first end of said connection member comprises a loop sized and proportioned to accommodate a shirt button.

15. The device of claim 1, wherein the second end of said connection member is a loop.

16. A method of securing a tie to a shirt, said tie comprising an inner opening and opposing inner edges, said method comprising the steps:

applying a compression force onto a flexible semi-circular portion of a device having first and second arms positioned at opposite ends of the semi-circular portion and defining a central connection portion;

inserting said compressed flexible semi-circular portion into said inner opening of said tie;

releasing said compression force from said semi-circular portion such that said first and second arms engage with said opposing inner edges of said tie in a friction fit connection; and attaching a connection member, that is connected to said central connection portion of the device, to said shirt.

17. The method of claim 16, wherein said semi-circular portion of the device additionally comprises first and second compression grips, positioned such that the step of applying said compression force facilitates compression of said flexible semi-circular portion of the device from an open configuration to a compressed installation configuration.

18. The method of claim 17, wherein releasing said compression force facilitates expansion of said flexible semi-circular portion of the device from said compressed installation configuration to an installed configuration.

19. The method of claim 16, wherein the connection member, that is connected to said central connection portion of the device, comprises a clip and said step of attaching the device to said shirt is achieved by clamping opposing jaws of said clip to a button hole seam of said shirt.

* * * * *